US007775285B2

(12) United States Patent
Surjaatmadja et al.

(10) Patent No.: US 7,775,285 B2
(45) Date of Patent: Aug. 17, 2010

(54) APPARATUS AND METHOD FOR SERVICING A WELLBORE

(75) Inventors: Jim B. Surjaatmadja, Duncan, OK (US); Loyd East, Jr., Houston, TX (US)

(73) Assignee: Halliburton Energy Services, Inc., Ducan, OH (US)

( * ) Notice: Subject to any disclaimer, the term of this patent is extended or adjusted under 35 U.S.C. 154(b) by 0 days.

(21) Appl. No.: 12/274,193

(22) Filed: Nov. 19, 2008

(65) Prior Publication Data

US 2010/0122817 A1 May 20, 2010

(51) Int. Cl.
*E21B 34/10* (2006.01)
*E21B 43/26* (2006.01)

(52) U.S. Cl. ..... 166/374; 166/222; 166/308.1; 166/312; 166/317

(58) Field of Classification Search ..... None
See application file for complete search history.

(56) References Cited

U.S. PATENT DOCUMENTS

| | | | |
|---|---|---|---|
| 2,201,290 | A | 5/1940 | Greene |
| 2,913,051 | A | 11/1959 | Lister |
| 3,057,405 | A | 10/1962 | Mallinger |
| 3,216,497 | A | 11/1965 | Howard et al. |
| 3,434,537 | A | 3/1969 | Zandmer |
| 4,105,069 | A | 8/1978 | Baker |
| 4,673,039 | A | 6/1987 | Mohaupt |
| 5,125,582 | A | 6/1992 | Surjaatmadja et al. |
| 5,325,917 | A | 7/1994 | Szarka |
| 5,325,923 | A | 7/1994 | Surjaatmadja et al. |
| 5,361,856 | A | 11/1994 | Surjaatmadja et al. |
| 5,366,015 | A | 11/1994 | Surjaatmadja et al. |
| 5,381,862 | A | 1/1995 | Szarka et al. |

(Continued)

FOREIGN PATENT DOCUMENTS

| | | | |
|---|---|---|---|
| GB | 2415213 | A | 12/2005 |

(Continued)

OTHER PUBLICATIONS

Foreign communication from a related counterpart application—International Search Report and Written Opinion, PCT/GB2009/002693, Mar. 2, 2010, 10 pages.

(Continued)

*Primary Examiner*—Zakiya W. Bates
(74) *Attorney, Agent, or Firm*—John W. Wustenberg; Conley Rose, P.C.

(57) ABSTRACT

A wellbore servicing apparatus, comprising a housing comprising a plurality of housing ports, a sleeve being movable with respect to the housing, the sleeve comprising a plurality of sleeve ports to selectively provide a fluid flow path between the plurality of housing ports and the plurality of sleeve ports, and a sacrificial nozzle in fluid communication with at least one of the plurality of the housing ports and the plurality of sleeve ports. A method of servicing a wellbore, comprising placing a stimulation assembly in the wellbore, the stimulation assembly comprising a housing comprising a plurality of housing ports, a selectively adjustable sleeve comprising a plurality of sleeve ports, and a sacrificial nozzle in fluid communication with one of the plurality of the housing ports and the plurality of sleeve ports, the sacrificial nozzle comprising an aperture, a fluid interface, and a housing interface.

24 Claims, 11 Drawing Sheets

U.S. PATENT DOCUMENTS

| | | | | |
|---|---|---|---|---|
| 5,396,957 | A | 3/1995 | Surjaatmadja et al. | |
| 5,425,424 | A | 6/1995 | Reinhardt et al. | |
| 5,484,016 | A | 1/1996 | Surjaatmadja et al. | |
| 5,494,103 | A | 2/1996 | Surjaatmadja et al. | |
| 5,499,678 | A | 3/1996 | Surjaatmadja et al. | |
| 5,533,571 | A | 7/1996 | Surjaatmadja et al. | |
| 5,765,642 | A | 6/1998 | Surjaatmadja | |
| 5,944,105 | A | 8/1999 | Nguyen | |
| 6,006,838 | A | 12/1999 | Whiteley et al. | |
| 6,189,618 | B1 * | 2/2001 | Beeman et al. | 166/312 |
| 6,286,599 | B1 | 9/2001 | Surjaatmadja et al. | |
| 6,336,502 | B1 | 1/2002 | Surjaatmadja et al. | |
| 6,662,874 | B2 | 12/2003 | Surjaatmadja et al. | |
| 6,719,054 | B2 | 4/2004 | Cheng et al. | |
| 6,725,933 | B2 | 4/2004 | Middaugh et al. | |
| 6,779,607 | B2 | 8/2004 | Middaugh et al. | |
| 6,938,690 | B2 | 9/2005 | Surjaatmadja | |
| 7,066,265 | B2 | 6/2006 | Surjaatmadja | |
| 7,090,153 | B2 | 8/2006 | King et al. | |
| 7,159,660 | B2 | 1/2007 | Justus | |
| 7,195,067 | B2 | 3/2007 | Manke et al. | |
| 7,225,869 | B2 | 6/2007 | Willett et al. | |
| 7,228,908 | B2 | 6/2007 | East, Jr. et al. | |
| 7,234,529 | B2 | 6/2007 | Surjaatmadja | |
| 7,237,612 | B2 | 7/2007 | Surjaatmadja et al. | |
| 7,243,723 | B2 | 7/2007 | Surjaatmadja et al. | |
| 7,273,099 | B2 | 9/2007 | East, Jr. et al. | |
| 7,287,592 | B2 | 10/2007 | Surjaatmadja et al. | |
| 7,296,625 | B2 | 11/2007 | East, Jr. | |
| 7,337,844 | B2 | 3/2008 | Surjaatmadja et al. | |
| 7,343,975 | B2 | 3/2008 | Surjaatmadja et al. | |
| 7,353,879 | B2 | 4/2008 | Todd et al. | |
| 7,398,825 | B2 | 7/2008 | Nguyen et al. | |
| 7,422,060 | B2 | 9/2008 | Hammami et al. | |
| 7,431,090 | B2 | 10/2008 | Surjaatmadja et al. | |
| 7,506,689 | B2 | 3/2009 | Surjaatmadja et al. | |
| 7,520,327 | B2 | 4/2009 | Surjaatmadja | |
| 7,527,103 | B2 | 5/2009 | Huang et al. | |
| 7,571,766 | B2 | 8/2009 | Pauls et al. | |
| 7,575,062 | B2 | 8/2009 | East, Jr. | |
| 2006/0086507 | A1 | 4/2006 | Surjaatmadja et al. | |
| 2006/0207765 | A1 * | 9/2006 | Hofman | 166/313 |
| 2007/0102156 | A1 | 5/2007 | Nguyen et al. | |
| 2007/0261851 | A1 | 11/2007 | Surjaatmadja | |
| 2007/0284114 | A1 | 12/2007 | Swor et al. | |
| 2008/0000637 | A1 | 1/2008 | McDaniel et al. | |
| 2008/0060810 | A9 | 3/2008 | Nguyen et al. | |
| 2008/0083531 | A1 | 4/2008 | Surjaatmadja | |
| 2008/0135248 | A1 | 6/2008 | Talley et al. | |
| 2008/0179060 | A1 | 7/2008 | Surjaatmadja et al. | |
| 2008/0202764 | A1 | 8/2008 | Clayton et al. | |
| 2008/0210429 | A1 | 9/2008 | McMillin et al. | |
| 2008/0217021 | A1 | 9/2008 | Lembcke et al. | |
| 2008/0264641 | A1 | 10/2008 | Slabaugh et al. | |
| 2009/0032255 | A1 | 2/2009 | Surjaatmadja et al. | |

FOREIGN PATENT DOCUMENTS

| | | | |
|---|---|---|---|
| WO | 2008093047 | A1 | 8/2008 |

OTHER PUBLICATIONS

Foreign communication from a related counterpart application—International Search Report and Written Opinion, PCT/GB2008/002646, Dec. 11, 2008, 9 pages.

* cited by examiner

APPARATUS AND METHOD FOR SERVICING A WELLBORE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a fracturing fluid may be introduced into a portion of a subterranean formation penetrated by a wellbore at a hydraulic pressure sufficient to create or enhance at least one fracture therein. Stimulating or treating the wellbore in such ways increases hydrocarbon production from the well. The fracturing equipment may be included in a stimulation assembly used in the overall production process.

In some wells, it may be desirable to individually and selectively create multiple fractures along a wellbore at a distance apart from each other, creating multiple "pay zones." The multiple fractures should have adequate conductivity, so that the greatest possible quantity of hydrocarbons in an oil and gas reservoir can be drained/produced into the wellbore. When stimulating a formation from a wellbore, or completing the wellbore, especially those wellbores that are highly deviated or horizontal, it may be challenging to control the creation of multiple fractures along the wellbore that can give adequate conductivity. For example, multiple fractures may create a complicated fracture geometry resulting in an undesirable high treating pressure and difficulty injecting significant proppant volumes. Enhancement in methods and apparatuses to overcome such challenges can further improve fracturing success and thus improve hydrocarbon production. Thus, there is an ongoing need to develop new methods and apparatuses to improve fracturing initiation and fracture extension.

SUMMARY

Disclosed herein is a wellbore servicing apparatus, comprising a housing comprising a plurality of housing ports, a sleeve being movable with respect to the housing, the sleeve comprising a plurality of sleeve ports to selectively provide a fluid flow path between the plurality of housing ports and the plurality of sleeve ports, and a sacrificial nozzle in fluid communication with at least one of the plurality of the housing ports and the plurality of sleeve ports.

Further disclosed herein is a method of servicing a wellbore, comprising placing a stimulation assembly in the wellbore, the stimulation assembly comprising a housing comprising a plurality of housing ports, a selectively adjustable sleeve comprising a plurality of sleeve ports, and a sacrificial nozzle in fluid communication with one of the plurality of the housing ports and the plurality of sleeve ports, the sacrificial nozzle comprising an aperture, a fluid interface, and a housing interface.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1A:
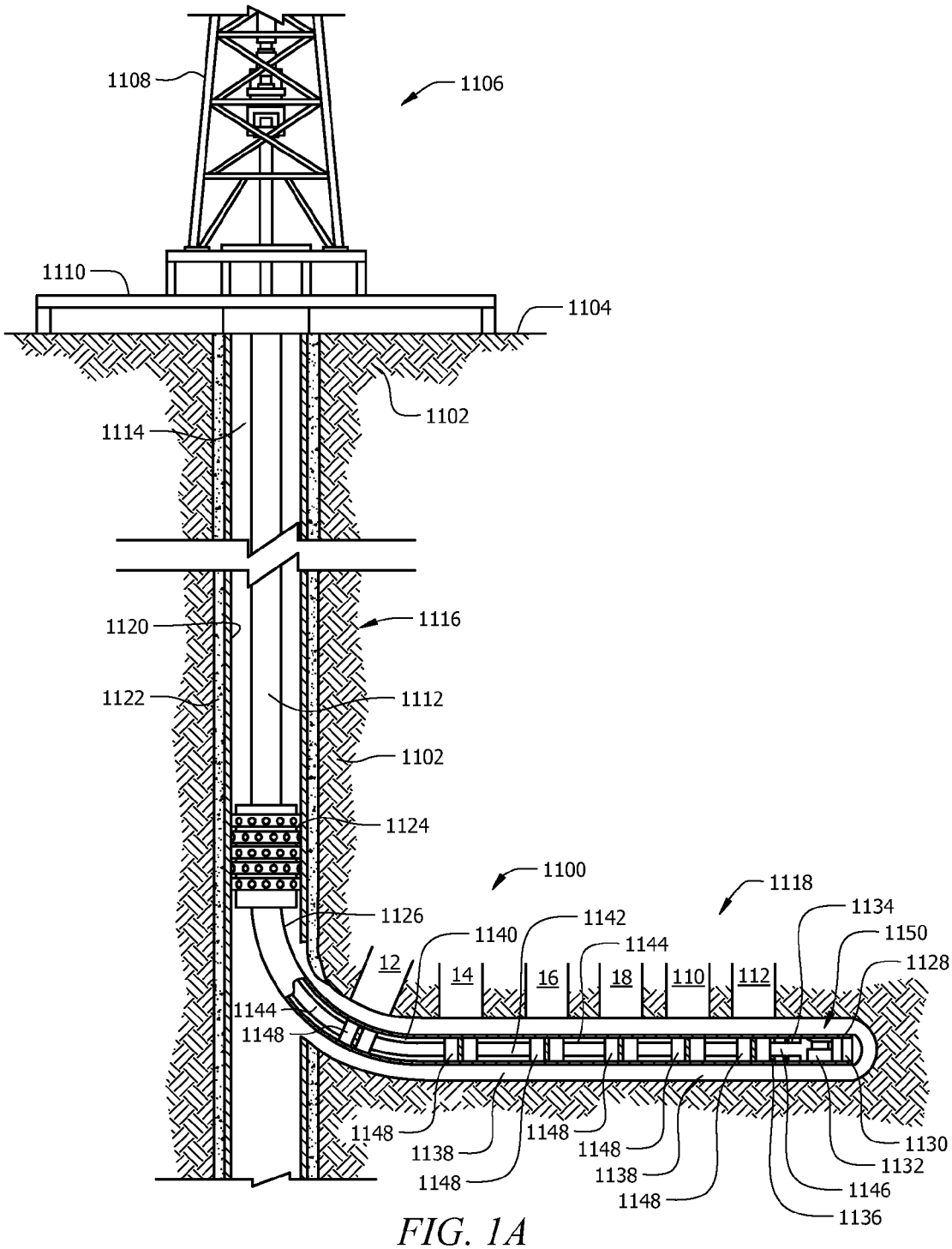
FIG. 1A is a simplified cut-away view of a wellbore completion apparatus in an operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The term "seat" as used herein may be referred to as a ball seat, but it is understood that seat may also refer to any type of catching or stopping device for an obturating member or other member sent through a work string fluid passage that comes to rest against a restriction in the passage. The various characteristics mentioned above, as well as other features and characteristics described in more detail below, will be readily apparent to those skilled in the art with the aid of this disclosure upon reading the following detailed description of the embodiments, and by referring to the accompanying drawings.

Referring to FIG. 1A, an embodiment of a wellbore servicing apparatus 1100 is shown in an operating environment. While the wellbore servicing apparatus 1100 is shown and described with specificity, various other wellbore servicing apparatus embodiments consistent with the teachings herein are described infra. As depicted, the operating environment comprises a drilling rig 1106 that is positioned on the earth's surface 1104 and extends over and around a wellbore 1114 that penetrates a subterranean formation 1102 for the purpose of recovering hydrocarbons. The wellbore 1114 may be drilled into the subterranean formation 1102 using any suitable drilling technique. The wellbore 1114 extends substantially vertically away from the earth's surface 1104 over a vertical wellbore portion 1116, and in some embodiments may deviate at one or more angles from the earth's surface 1104 over a deviated or horizontal wellbore portion 1118. In alternative operating environments, all or portions of the wellbore may be vertical, deviated at any suitable angle, horizontal, and/or curved, and may comprise multiple laterals extending at various angles from a primary, vertical wellbore.

At least a portion of the vertical wellbore portion 1116 is lined with a casing 1120 that is secured into position against the subterranean formation 1102 in a conventional manner using cement 1122. In alternative operating environments, the horizontal wellbore portion 1118 may be cased and cemented and/or portions of the wellbore may be uncased (e.g., an open hole completion). The drilling rig 1106 comprises a derrick 1108 with a rig floor 1110 through which a tubing or work string 1112 (e.g., cable, wireline, E-line, Z-line, jointed pipe, coiled tubing, casing, or liner string, etc.) extends downward from the drilling rig 1106 into the wellbore 1114. The work string 1112 delivers the wellbore servicing apparatus 1100 to a predetermined depth within the wellbore 1114 to perform an operation such as perforating the casing 1120 and/or subterranean formation 1102, creating a fluid path from the flow passage 1142 to the subterranean formation 1102, creating (e.g., initiating and/or extending) perforation tunnels and fractures (e.g., dominant/primary fractures, micro-fractures, etc.) within the subterranean formation 1102, producing hydrocarbons from the subterranean formation 1102 through the wellbore (e.g., via a production tubing or string), or other completion operations. The drilling rig 1106 comprises a motor driven winch (not shown) and other associated equipment (not shown) for extending the work string 1112 into the wellbore 1114 to position the wellbore servicing apparatus 1100 at the desired depth.

While the operating environment depicted in FIG. 1A refers to a stationary drilling rig 1106 for lowering and setting the wellbore servicing apparatus 1100 within a land-based wellbore 1114, one of ordinary skill in the art will readily appreciate that mobile workover rigs, wellbore servicing units (such as coiled tubing units), and the like may be used to lower the wellbore servicing apparatus 1100 into the wellbore 1114. It should be understood that the wellbore servicing apparatus 1100 may alternatively be used in other operational environments, such as within an offshore wellbore operational environment.

The wellbore servicing apparatus 1100 comprises an upper end comprising a liner hanger 1124 (such as a Halliburton VersaFlex® liner hanger), a lower end 1128, and a tubing section 1126 extending therebetween. The tubing section 1126 comprises a toe assembly 1150 for selectively allowing fluid passage between flow passage 1142 and annulus 1138. The toe assembly 1150 comprises a float shoe 1130, a float collar 1132, a tubing conveyed device 1134, and a polished bore receptacle 1136 housed near the lower end 1128. In alternative embodiments, a tubing section may further comprise a plurality of packers that function to isolate formation zones from each other along the tubing section. The plurality of packers may be any suitable packers such as swellpackers, inflatable packers, squeeze packers, production packers, or combinations thereof.

The horizontal wellbore portion 1118 and the tubing section 1126 define an annulus 1138 therebetween. The tubing section 1126 comprises an interior wall 1140 that defines a flow passage 1142 therethrough. An inner string 1144 is disposed in the flow passage 1142 and the inner string 1144 extends therethrough so that an inner string lower end 1146 connects to toe assembly 1150. The float shoe 1130, the float collar 1132, the tubing conveyed devices 1134, and the polished bore receptacle 1136 of toe assembly 1150 are actuated by mechanical shifting techniques as necessary to allow fluid communication between fluid passage 1142 and annulus 1138. However, in alternative embodiments, the toe assemblies may be configured to be actuated by any suitable method such as hydraulic shifting, etc.

By way of a non-limiting example, six stimulation assemblies 1148 are connected and disposed in-line along and in fluid communication with inner string 1144, and are housed in the flow passage 1142 of the tubing section 1126. Each of the formation zones 12, 14, 16, 18, 110, and 112 has a separate and distinct one of the six stimulation assemblies 1148 associated therewith. Each stimulation assembly 1148 can be independently selectively actuated to expose different formation zones 12, 14, 16, 18, 110, and/or 112 for stimulation and/or production (e.g., flow of a wellbore servicing fluid from the flow passage 1142 of the work string 1112 to the formation and/or flow of a production fluid to the flow passage 1142 of the work string 1112 from the formation) at different times. In this embodiment, the stimulation assemblies 1148 are mechanical shift actuated. In alternative embodiments, the stimulation assemblies may be hydraulically actuated, mechanically actuated, electrically actuated, coiled tubing actuated, wireline actuated, or combinations thereof to increase or decrease a fluid path between the interior of stimulation assemblies and the associated formation zones (e.g., by opening and/or closing a window or sliding sleeve).

Figure 1B:
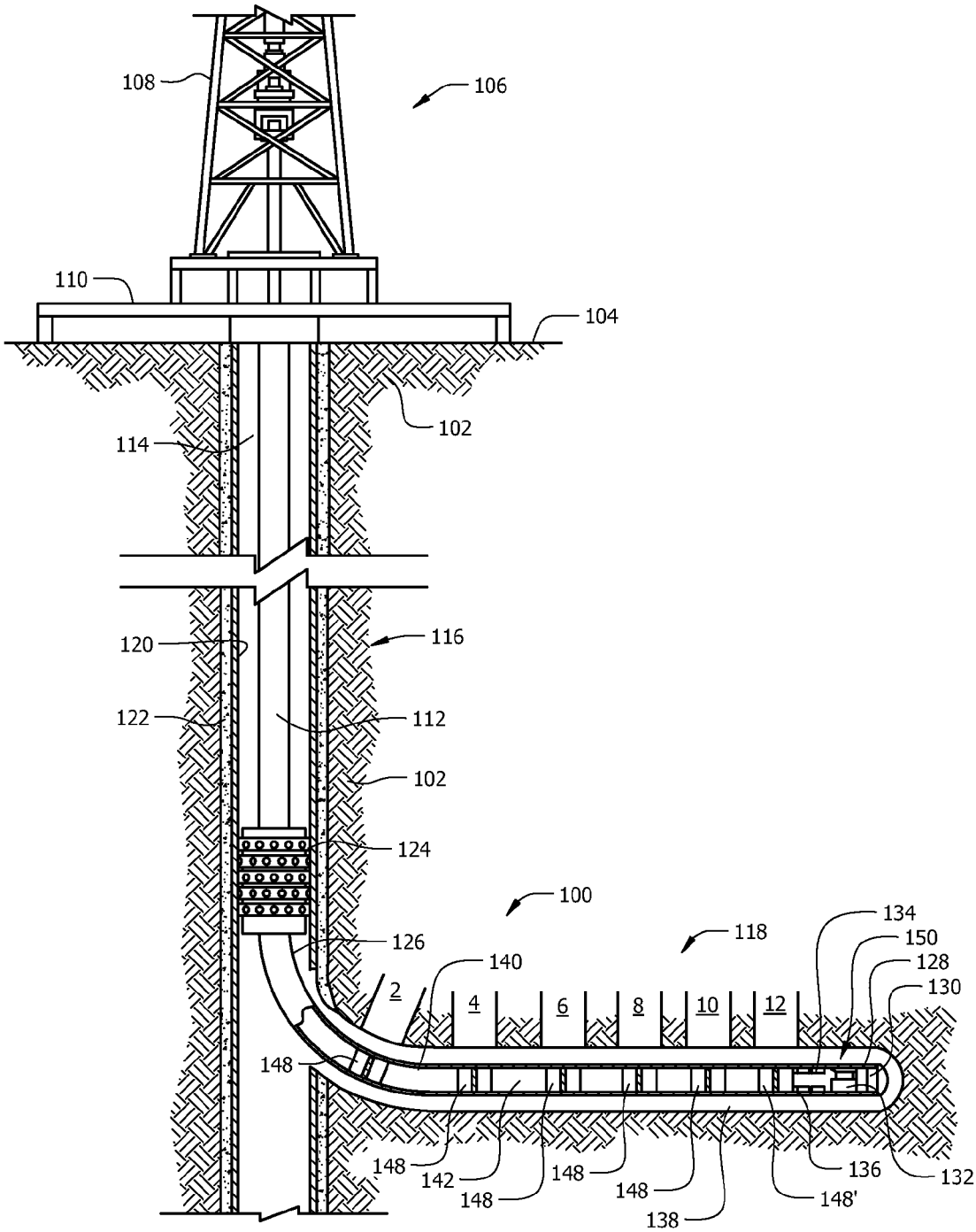
FIG. 1B is another simplified cut-away view of a wellbore completion apparatus in an operating environment.

Referring now to FIG. 1B, an alternative embodiment of a wellbore servicing apparatus 100 is shown in an operating environment. The wellbore servicing apparatus 100 is substantially similar to the wellbore servicing apparatus 1100 of FIG. 1A. However, one difference between the wellbore servicing apparatuses 1100 and 100 is that the wellbore servicing apparatus 1100 is actuated by mechanical shifting while the wellbore servicing apparatus 100 is actuated by hydraulic shifting, as described infra.

The wellbore servicing apparatus 100 comprises a drilling rig 106 that is positioned on the earth's surface 104 and extends over and around a wellbore 114 that penetrates a subterranean formation 102 for the purpose of recovering hydrocarbons. The wellbore 114 extends substantially vertically away from the earth's surface 104 over a vertical wellbore portion 116, and in some embodiments may deviate at one or more angles from the earth's surface 104 over a deviated or horizontal wellbore portion 118.

At least a portion of the vertical wellbore portion 116 is lined with a casing 120 that is secured into position against the subterranean formation 102 in a conventional manner using cement 122. The drilling rig 106 comprises a derrick 108 with a rig floor 110 through which a tubing or work string 112 (e.g., cable, wireline, E-line, Z-line, jointed pipe, coiled tubing, casing, or liner string, etc.) extends downward from the drilling rig 106 into the wellbore 114. The work string 112 delivers the wellbore servicing apparatus 100 to a predetermined depth within the wellbore 114 to perform an operation such as perforating the casing 120 and/or subterranean formation 102, creating a fluid path from the flow passage 142 to the subterranean formation 102, creating (e.g., initiating and/or extending) perforation tunnels and fractures (e.g., dominant/primary fractures, micro-fractures, etc.) within the subterranean formation 102, producing hydrocarbons from the subterranean formation 102 through the wellbore (e.g., via a production tubing or string), or other completion operations. The drilling rig 106 comprises a motor driven winch and other associated equipment for extending the work string 112 into the wellbore 114 to position the wellbore servicing apparatus 100 at the desired depth.

The wellbore servicing apparatus 100 comprises an upper end comprising a liner hanger 124 (such as a Halliburton VersaFlex® liner hanger), a lower end 128, and a tubing section 126 extending therebetween. The tubing section 126 comprises a toe assembly 150 for selectively allowing fluid passage between flow passage 142 and annulus 138. The toe assembly 150 comprises a float shoe 130, a float collar 132, a tubing conveyed device 134, and a polished bore receptacle 136 housed near the lower end 128. However, in this embodiment, the components of toe assembly 150 (float shoe 130, float collar 132, tubing conveyed device 134, and polished bore receptacle 136) are actuated by hydraulic shifting as necessary to allow fluid communication between flow passage 142 and annulus 138.

The horizontal wellbore portion 118 and the tubing section 126 define an annulus 138 therebetween. The tubing section 126 comprises an interior wall 140 that defines a flow passage 142 therethrough.

By way of a non-limiting example, six stimulation assemblies 148, one of which is a stimulation assembly 148', are connected and disposed in-line along the tubing section 126, and are housed in the flow passage 142 of the tubing section 126. Each of the formation zones 2, 4, 6, 8, 10, and 12 has a separate and distinct one of the six stimulation assemblies 148 associated therewith. Each stimulation assembly 148 can be independently selectively actuated to expose different formation zones 2, 4, 6, 8, 10, and/or 12 for stimulation and/or production (e.g., flow of a wellbore servicing fluid from the flow passage 142 of the work string 112 to the formation and/or flow of a production fluid to the flow passage 142 of the work string 112 from the formation) at different times. In this embodiment, the stimulation assemblies 148 are ball drop actuated. In alternative embodiments, the stimulation assemblies may be mechanical shift actuated, mechanically actuated, hydraulically actuated, electrically actuated, coiled tubing actuated, wireline actuated, or combinations thereof to increase or decrease a fluid path between the interior of stimulation assemblies and the associated formation zones (e.g., by opening and/or closing a window or sliding sleeve). In this embodiment, the stimulation assemblies 148 are Delta Stim® Sleeves which are available from Halliburton Energy Services, Inc. However, in alternative embodiments, the stimulation assemblies may be any suitable stimulation assemblies.

Figure 2:
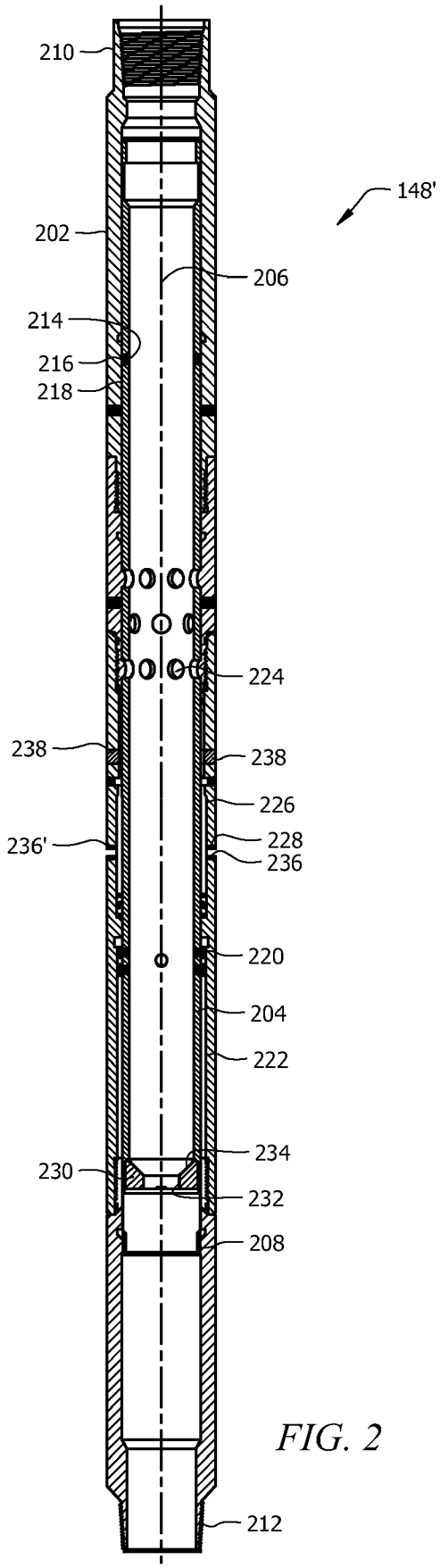
FIG. 2 is a cross-sectional view of a stimulation assembly of the wellbore completion apparatus of FIG. 1B.

Referring now to FIG. 2, the stimulation assembly 148' that is associated with the formation zone 12 is shown in greater detail. The stimulation assembly 148' comprises a housing 202 with a sleeve 204 detachably connected therein. The housing 202 comprises a plurality of housing ports 228 defined therein. The sleeve 204 comprises a sleeve lower end 208. The sleeve 204 further comprises a central flowbore 206 that allows fluid communication between the stimulation assembly 148' and the flow passage 142 (shown in FIG. 1B). After being detached from the housing 202, the sleeve 204 is slidable or movable in the housing 202 as explained infra. The housing 202 has an housing upper end 210 and a housing lower end 212, both of which are configured to be directly connected to or threaded into tubing section 126 (or in alternative embodiments of a wellbore servicing apparatus, to other stimulation assemblies) such that the housing 202 makes up a part of the tubing section 126 shown in FIG. 1B. Still referring to FIG. 2, the sleeve 204 is initially connected to the housing 202 with a snap ring 214 that extends into a groove 216 defined on a housing inner surface 218 of the housing 202. In addition, shear pins extend through the housing 202 and into the sleeve 204 to detachably connect the sleeve 204 to the housing 202. Guide pins 220 are threaded or otherwise attached to the sleeve 204 and are received in axial grooves or axial slots 222 of the housing 202. The guide pins 220 are slidable in the axial slots 222 thereby preventing relative rotation between the sleeve 204 and the housing 202. The sleeve 204 comprises a plurality of sleeve ports 224 therethrough. An annular gap 226 formed by a recess of the interior wall of the housing 202 serves to provide a fluid path between the sleeve ports 224 and the housing ports 228 when the sleeve ports 224 are at least partially radially aligned with the annular gap 226. The stimulation assembly 148' further comprises at least one sacrificial nozzle 236 (one of those being labeled 236') and at least one plug 238, each being positioned within separate and distinct housing ports 228. In other words, each housing port 228 comprises either the sacrificial nozzle 236 or the plug 238. In some alternative embodiments, a single stimulation assembly may have 18 to 24 housing ports. In those embodiments, there may be 10 to 16 sacrificial nozzles and 8 to 16 plugs positioned within the housing ports. In alternative embodiments, the sacrificial nozzles and/or the plugs may be positioned adjacent to (e.g., screwed into but protruding from) the housing ports.

Both the sacrificial nozzle 236 and the plug 238 are cylindrical in shape, each having an outer diameter that sufficiently complements the housing ports 228. The sacrificial nozzle 236 is discussed infra in greater detail. The plug 238 is constructed of aluminum that can be removed by degradation of the aluminum by exposing the aluminum to an acid. In alternative embodiments, the plug may be constructed of any other suitable material (e.g., composite, plastic, etc.) that can be removed by any suitable method such as degradation, mechanical removal, etc., as described infra.

The sleeve ports 224 are radially misaligned (or longitudinally offset along the central lengthwise axis of the stimulation assembly 148') from the annular gap 226 so that the stimulation assembly 148' is in a closed position where there is no access to the formation zone 12. In other words, in the closed position, there is no fluid path between the flowbore 206 and the formation zone 12. The sleeve 204 comprises a seat ring 230 operably associated therewith and is connected therein at or near the sleeve lower end 208. The seat ring 230 has a seat ring central opening 232 defining a seat ring diameter therethrough. The seat ring 230 also has a seat surface 234 for engaging an obturating member (e.g., a ball or dart) that may be dropped through the flowbore 206 to actuate (e.g., open) the sleeve 204 by at least partially radially and/or longitudinally aligning the sleeve ports 224 with the annular gap 226.

To move the sleeve 204 from the closed position to an open position, an obturating member, such as a closing ball, may be dropped through the work string 112 (shown in FIG. 1B) so that it engages the seat surface 234 on the seat ring 230. Although the obturating member is typically a ball, other types of obturating members may be used such as plugs and darts that engage the seat surface and prevent flow therethrough. With the obturating member in place on the seat ring 230 and blocking flow, pressure is increased to overcome the holding force applied by the snap ring 214 and the shear pins, thereby moving the sleeve 204 to an open position where a fluid path exists between the sleeve ports 224 and the housing ports 228 via the annular gap 226 to allow passage of fluids between the flowbore 206 and the formation zone 12.

Figure 3:
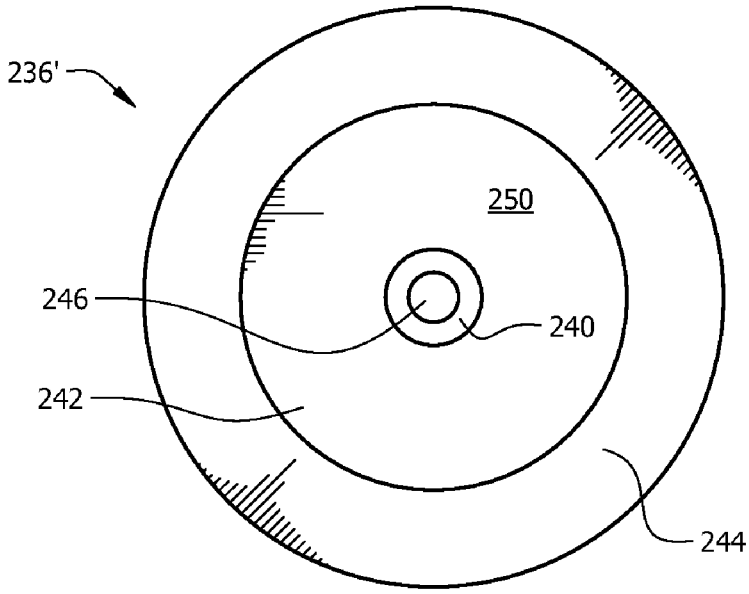
FIG. 3 is an orthogonal view of a sacrificial nozzle of the stimulation assembly of FIG. 2.
Figure 4:
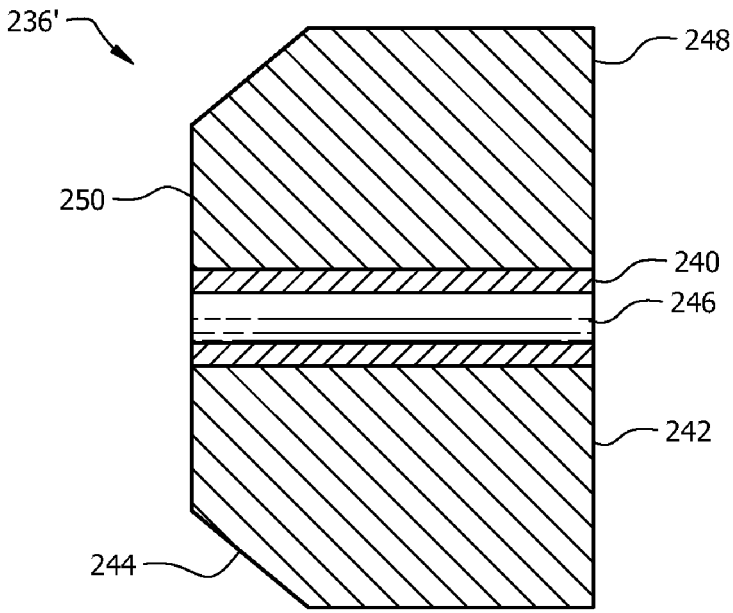
FIG. 4 is an orthogonal cross-sectional view of the sacrificial nozzle of the stimulation assembly of FIG. 2.
Figure 5:
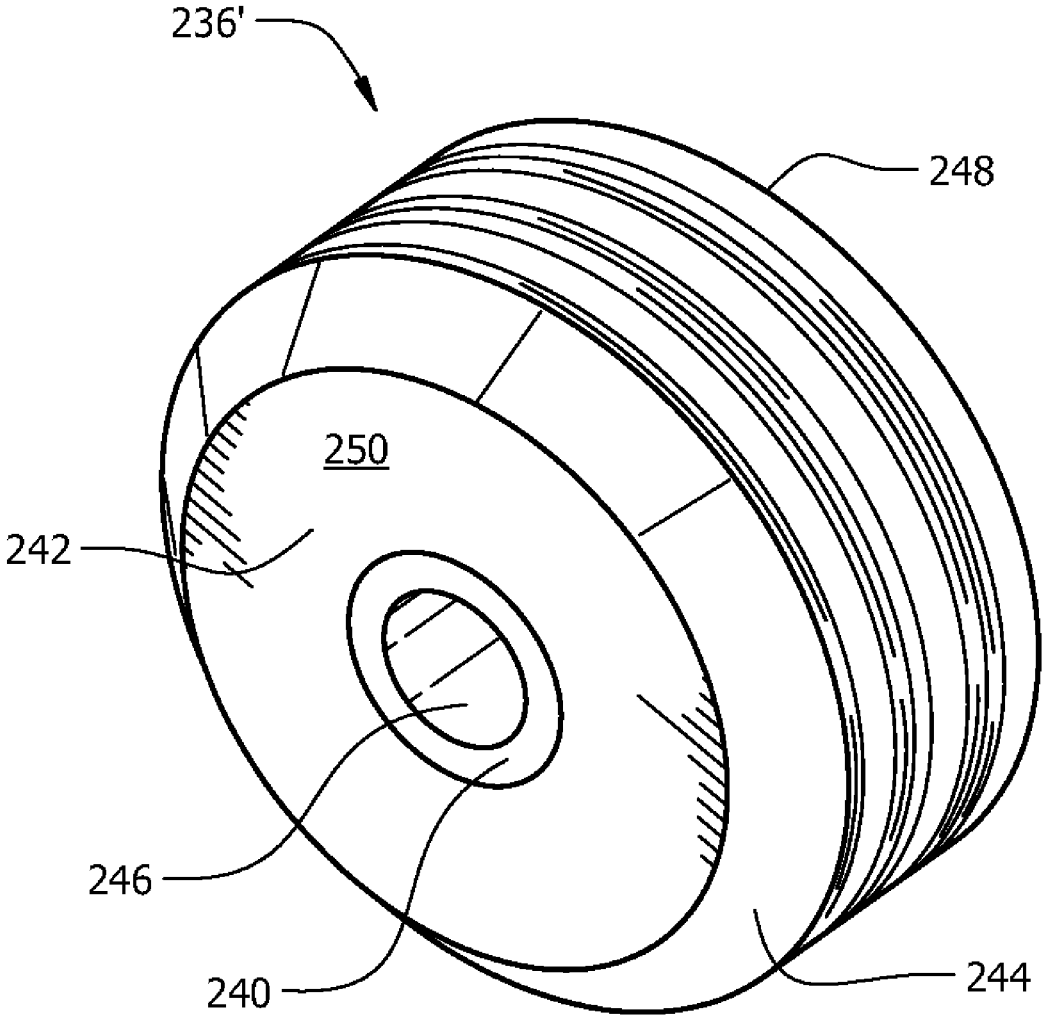
FIG. 5 is an oblique view of the sacrificial nozzle of the stimulation assembly of FIG. 2.

Referring now to FIGS. 3-5, the sacrificial nozzle 236' is shown in greater detail. The sacrificial nozzle 236' comprises a generally cylindrical body having a fluid interface 240 defining an aperture 246, and a housing interface 242 securing the fluid interface 240 with respect to the housing 202 (shown in FIG. 2). The sacrificial nozzle 236' also comprises an outer end 248 that faces the formation zone 12 and an inner end 250 that faces the flowbore 206. The housing interface 242 is annular in shape with an outer diameter that sufficiently complements the housing port 228 shown in FIG. 2 to secure the housing interface 242 with respect to the housing port 228. The inner diameter of the housing interface 242 is also cylindrical in shape and is configured to complement the outer diameter of the fluid interface 240. The annular thickness of the housing interface 242 is defined by the difference between the radius of the housing ports 228 and the radius of the fluid interface 240. However, the annular thickness of the housing interface may be adjustable depending on the need of the process and may be determined by one or ordinary skill in the art with the aid of this disclosure, as described infra. The inner end 250 of the housing interface 242 has a housing interface beveled portion 244 for easier insertion of the sacrificial nozzle 236' into the housing 202. While the inner end 250 is beveled in this embodiment, in alternative embodiments, the inner end may not be beveled. The outer end 248 of the housing interface 242 is not beveled in this embodiment, however, in alternative embodiments, the outer end may be beveled to increase surface area for exposure to acid and reduce the amount of time needed to structurally compromise the housing interface as described infra. In alternative embodiments, the outer end 248 is curved to correspond with the curvature of the housing 202, and thereby be flush when installed therein. The housing interface 242 is constructed of aluminum that can be structurally compromised by contacting the housing interface 242 with an acid. In alternative embodiments, the housing interface may be constructed of any other suitable material or combination of materials that can be separated from the housing ports by any suitable method such as degradation, mechanical removal, etc. For example, the housing interface may be constructed of water soluble materials (e.g., water soluble aluminum, biodegradable polymer such as polylactic acid, etc.), acid soluble materials (e.g., aluminum, steel, etc.), thermally degradable materials (e.g., magnesium metal, thermoplastic materials, composite materials, etc.), or combinations thereof.

The fluid interface 240 is positioned concentrically inside the housing interface 242 and is also cylindrical in shape with an outer diameter that sufficiently complements the inner diameter of the housing interface 242. In alternative embodiments, the outer shape of the fluid interface may be any suitable shape that fits within the housing interface.

The aperture 246 is positioned concentrically inside the fluid interface 240. The aperture 246 allows fluid communication between the flowbore 206 (shown in FIG. 2) and the flow passage 142 (shown in FIG. 1B). The aperture 246 is cylindrical in shape, however, in alternative embodiments, the shape of the aperture may be any suitable shape. The diameter of the aperture 246 may change in size (e.g., increase) during a wellbore servicing process, as described infra. The fluid interface 240 is constructed of steel that can be abraded by contact with the passage of particle laden fluids (such as perforating and/or fracturing fluids) through the aperture 246. In this way, the fluid interface 240 is sacrificed by the resultant abrasion. In alternative embodiments, the fluid interface may be constructed of any other suitable materials that can be degraded and/or removed by any suitable methods such as those described infra. The type of material and the hardness of the material suitable for the fluid interface can be selected based on the need of a wellbore servicing process taking into consideration flow rates and pressures, wellbore service fluid types (e.g., particulate type and/or concentration) etc.

The sacrificial nozzle 236' is configured to serve multiple functions and is sacrificed as described infra. One function of the sacrificial nozzle 236' is to increase the velocity of a fluid as it passes from the flowbore 206 (shown in FIG. 2) through the sacrificial nozzle 236' to the formation zone 12 (shown in FIG. 1B). The sacrificial nozzle 236' is configured to restrict fluid flow thus increase the fluid velocity (i.e., jetting the fluid) as the fluid passes through the sacrificial nozzle 236'. The jetted fluid is jetted at a sufficient fluid velocity so that the jetted fluid can ablate and/or penetrate the formation zone 12, thereby forming perforation tunnels, micro-fractures, and/or extended fractures. The jetted fluid is flowed through the aperture 246 for a jetting period to form a perforation tunnel, micro-fractures, and/or extended fractures within the formation zone 12 as described infra. Generally, the velocity of a jetted fluid is greater than 300 feet per second (ft/sec).

Another function of the sacrificial nozzle 236' is to be removable from the housing ports 228 to allow unrestricted fluid communication between the flowbore 206 and the formation zone 12 (shown in FIG. 2). The sacrificial nozzle 236' can be removed after the formation of the perforation tunnel to allow unrestricted fluid flow through the housing ports 228. The housing interface 242 of the sacrificial nozzle 236' is removed by degradation by exposing the housing interface 242 with an acid. In this way, the sacrificial nozzle 236' is sacrificed by degrading the housing interface 242 with an acid. However, any suitable methods, such as degradation, mechanical removal, etc., as described infra, may be used to remove the housing interface. In an embodiment, the housing interface 242 and the fluid interface 240 are made of different material such that they may be removed in subsequent steps as described in more detail herein. For example, the fluid interface 240 may be made of a harder material such as steel to provide a controlled degradation rate during a jetting period, and the housing interface 242 may be made of a softer material such as aluminum (or composite, etc.) to facilitate removal (e.g., a faster degradation rate) after the jetting period.

Figure 6:
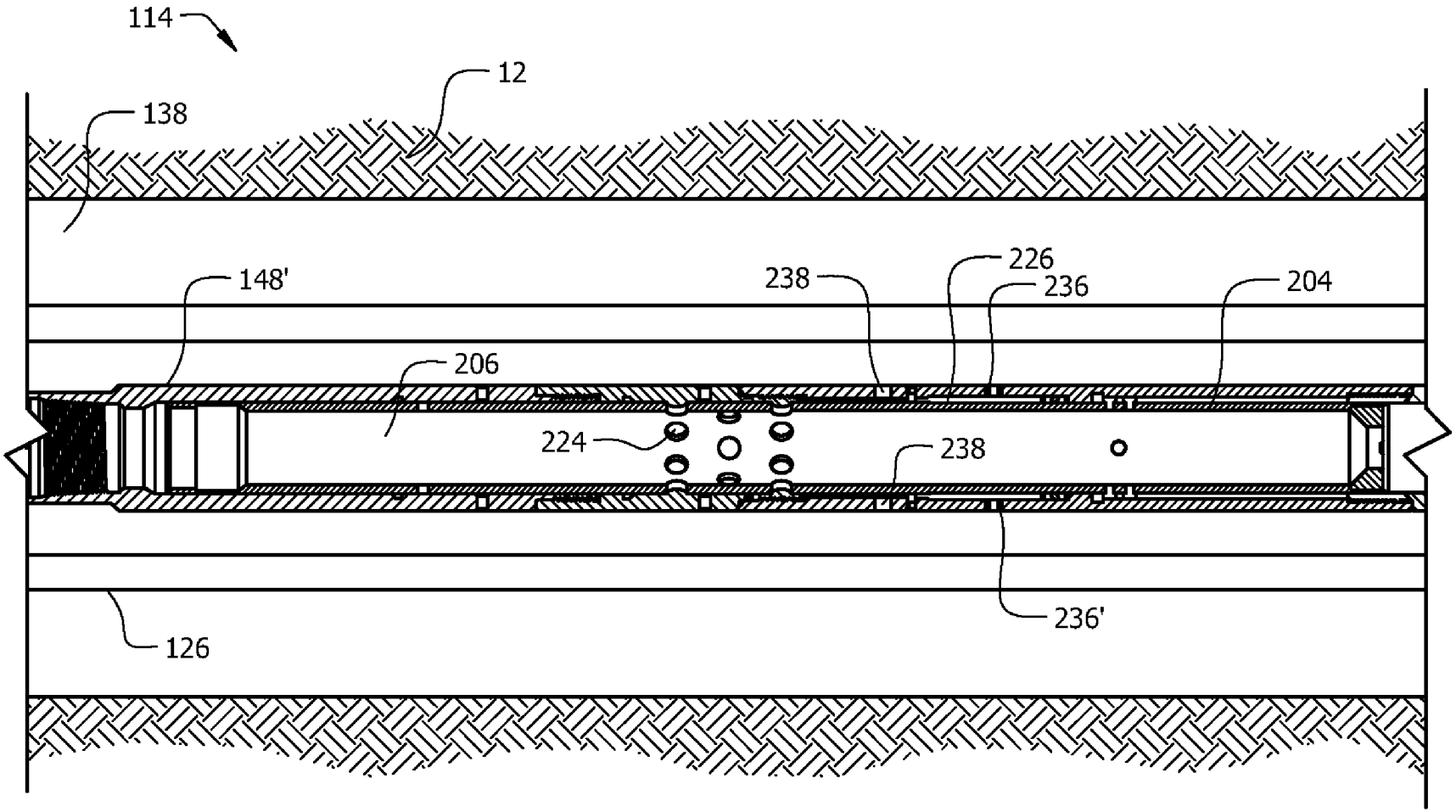
FIG. 6 is an orthogonal cross-sectional view of the stimulation assembly of FIG. 2 at the beginning of a wellbore servicing operation.

The steps of operating the stimulation assembly 148' to service the wellbore 114 are shown in FIGS. 6-9. Generally, servicing a wellbore 114 may be carried out for a plurality of formation zones (as shown in FIG. 1B) starting from a formation zone in the furthest or lowermost end of the wellbore 114 (i.e., toe) and sequentially backward toward the closest or uppermost end of the wellbore 114 (i.e., heel). Referring to FIG. 1B, the wellbore servicing begins by disposing a liner hanger comprising a float shoe and a float collar disposed near the toe, and a tubing section 126 comprising a plurality of stimulation assemblies 148 (including the stimulation assembly 148', which is shown in greater detail in FIG. 6). The stimulation assembly 148' is positioned adjacent the formation zone 12 to be treated. While the orientation of the stimulation assembly 148' is horizontal, in alternative methods of servicing a wellbore, the stimulation assembly may be deviated, vertical, or angled, which can be selected based on the wellbore conditions. Prior to stimulation, cementing of the wellbore may be performed via the float shoe and collar. Upon beginning the stimulation treatment, the stimulation assembly 148' is initially in a closed position wherein there is no fluid communication between the flowbore 206 and the formation zone 12, as shown in FIG. 6. In the closed position, the stimulation assembly 148' comprises sleeve ports 224 and an annular gap 226 that are radially and/or longitudinally misaligned from housing ports 228.

Figure 7:
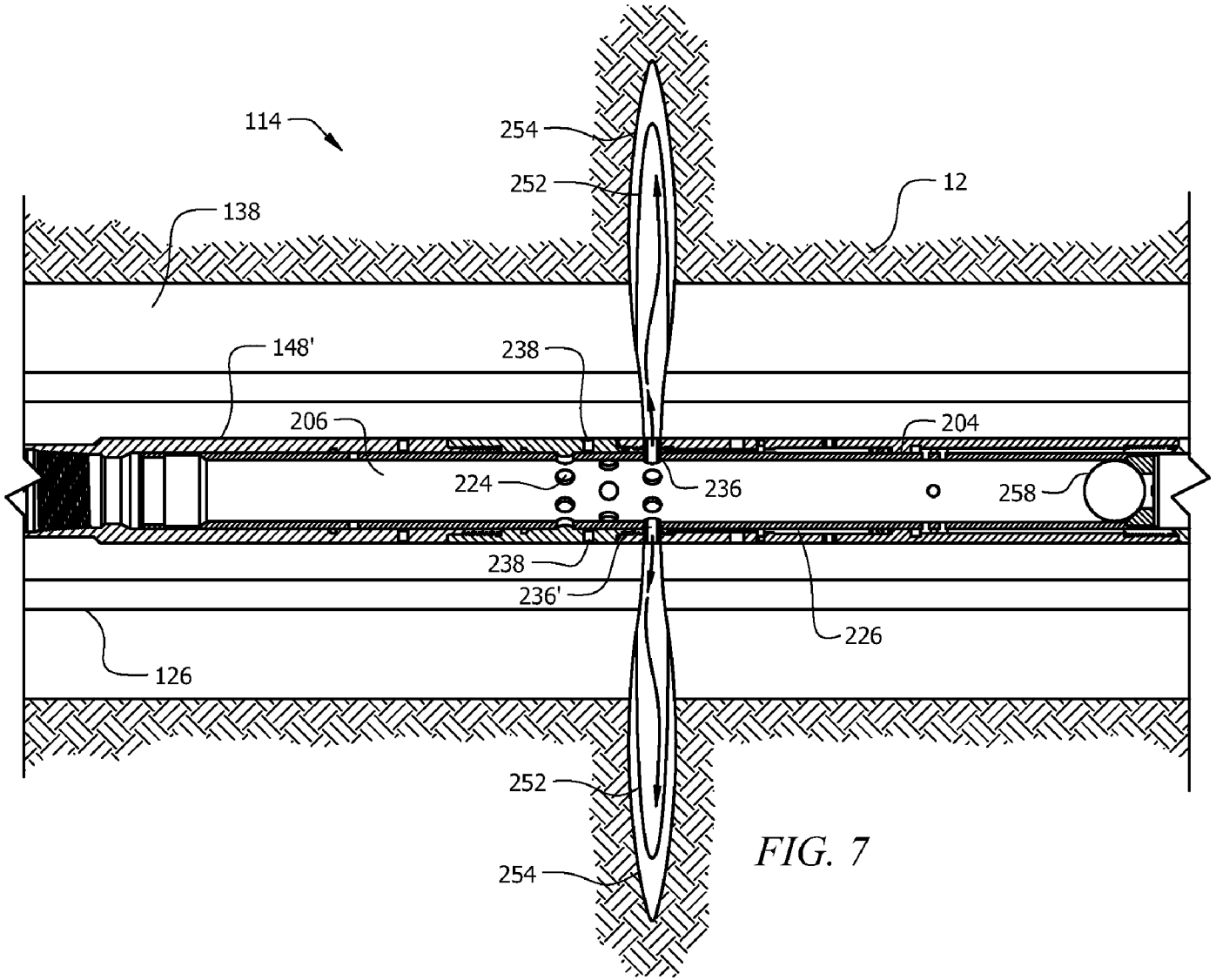
FIG. 7 is an orthogonal cross-sectional view of the stimulation assembly of FIG. 2 after the formation of perforation tunnels.

Referring now to FIG. 7, the formation of perforation tunnels 254 in the formation zone 12 and the eroded fluid interface 240 are illustrated. To service the formation zone 12, the formation zone 12 is exposed by aligning (i.e., opening) the sleeve ports 224 and the annular gap 226 with the housing ports 228 of the stimulation assembly 148'. The aligning is carried out by dropping an obturating member 258 such as a ball, however, in alternative embodiments, the aligning may be carried out by hydraulically applying pressure, by mechanically, or electrically shifting the sleeve to move the sleeve ports and the annular gap. The aligning is carried out until sleeve ports 224 and the annular gap 226 are completely aligned with the housing ports 228 to a fully opened position. In alternative embodiments, the aligning may be carried out until the sleeve ports and the annular gap are partially aligned with the housing ports to a partially opened position. An abrasive wellbore servicing fluid (such as a fracturing fluid, a particle laden fluid, a cement slurry, etc.) is pumped down the wellbore 114 into the flowbore 206 and through the sacrificial nozzle 236. In an embodiment, the wellbore servicing fluid is an abrasive fluid comprising from about 0.5 to about 1.5 pounds of abrasives and/or proppants per gallon of the mixture (lbs/gal), alternatively from about 0.6 to about 1.4 lbs/gal, alternatively from about 0.7 to about 1.3 lbs/gal.

The abrasive wellbore servicing fluid is pumped down to form fluid jets 252. Generally, the abrasive wellbore servicing fluid is pumped down at a sufficient flow rate and pressure to form the fluid jets 252 through the nozzles 236 at a velocity of from about 300 to about 700 feet per second (ft/sec), alternatively from about 350 to about 650 ft/sec, alternatively from about 400 to about 600 ft/sec for a period of from about 2 to about 10 minutes, alternatively from about 3 to about 9 minutes, alternatively from about 4 to about 8 minutes at a suitable original flow rate as needed by the stimulation process. The pressure of the abrasive wellbore servicing fluid is increased from about 2000 to about 5000 psig, alternatively from about 2500 to about 4500 psig, alternatively from about 3000 to about 4000 psig and the pumping down of the abrasive wellbore servicing fluid is continued at a constant pressure for a period of time.

As the abrasive wellbore servicing fluid is pumped down and passed through the sacrificial nozzle 236, the abrasive wellbore servicing fluid abrades the fluid interface 240 of the sacrificial nozzle 236, and increases the diameter of the aperture 246. During the jetting period, fluid flow rate is increased as necessary to substantially maintain the original jetting velocity even as the diameter of the aperture 246 increases. The type of material, the hardness of the material, and the thickness of the fluid interface 240 is configured so that as the fluid interface 240 is abraded by the abrasive wellbore servicing fluid (as shown by a thinning of the fluid interface 240 as the fluid interface 240 of the sacrificial nozzle 236 is sacrificed), the diameter of the aperture 246 increases, leaving the fluid interface 240 at least partially eroded at the end of the jetting period. In various embodiments, greater than 20, 30, 40, 50, 60, 70, 75, 80, 86, 90, 95, 96, 97, 98, or 99 percent of the fluid interface 240 is removed from the sacrificial nozzle 236, as may be measured by the increase in the diameter of the aperture 246 or the decrease in mass of the fluid interface 240 before and after the jetting period. In alternative embodiments, the fluid interface may be completely or substantially completely abraded away (i.e., sacrificed) at the end of jetting period. In other words in that alternative embodiment, when the fluid interface is sufficiently abraded away at the end of jetting period, the housing interface would be partially exposed (or completely exposed) and the diameter of the aperture would be equal to or similar to the inner diameter of the housing interface. At the end of the jetting period, fluid jets 252 have eroded the formation zone 12 to form perforation tunnels 254 (and optionally micro-fractures and/or extended fractures depending upon the treatment conditions and formation characteristics) within the formation zone 12. If needed, the flow rate of the abrasive wellbore servicing fluid may be increased typically to less than about 4 to 5 times the original flow rate to form perforation tunnels of desirable size. The formation of perforation tunnels are desirable when compared to multiple fractures (not shown). Typically, perforation tunnels lead to the formation of dominant/extended fractures, as described infra, which provide less restriction to hydrocarbon flow than multiple fractures, and increase hydrocarbon production flow into the wellbore 114.

Figure 8:
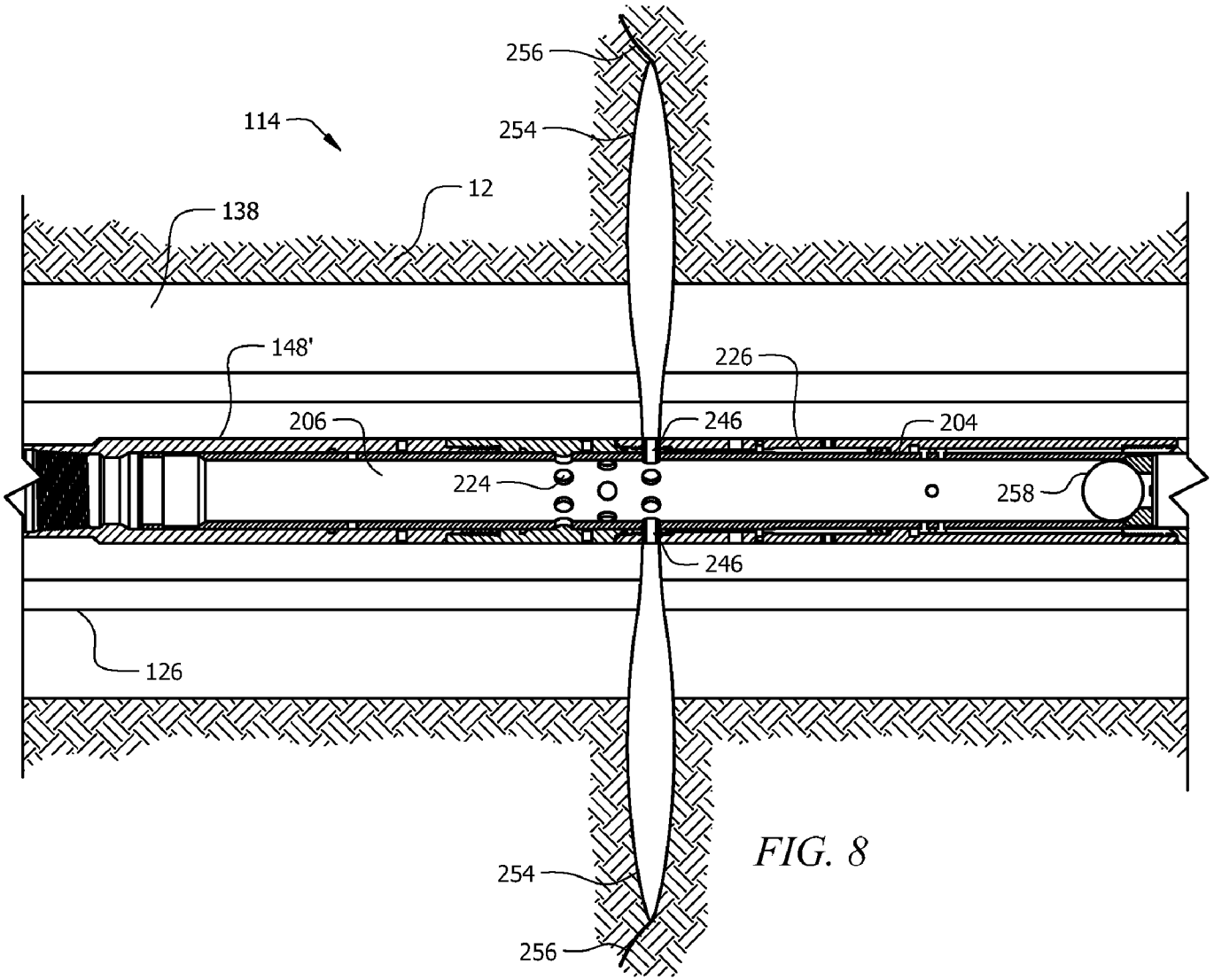
FIG. 8 is an orthogonal cross-sectional view of the stimulation assembly of FIG. 2 after the formation of dominant fractures.

Referring now to FIG. 8, a step where the housing interface 242 has been removed and the dominant/extended fractures 256 have been formed is illustrated. The housing interface 242 and other remains of the sacrificial nozzle 236 (shown in FIGS. 6 and 7) are removed, for example by continued abrasion by flow of the abrasive wellbore servicing fluid and/or by degradation such as contacting the housing interface 242 with an acid that degrades the housing interface 242 (i.e., aluminum). In other words, the sacrificial nozzle 236 is sacrificed and removed by continued abrasion and/or degrading the housing interface 242 and other remains of the sacrificial nozzle 236. The abrasive fluid and/or degradation fluid (e.g., acid) is pumped down the flowbore 206, through the sleeve ports 224, through the annular gap 226, and through the housing interface 242 for a sufficient time to completely (or partially) remove the housing interface 242. The plugs 238 are housed within the housing ports 228 and are constructed of the same material as the housing interface 242 (i.e., aluminum). The plugs 238 are also degraded with the acid, thereby removing the plugs 238. In alternative embodiments, the remaining sacrificial nozzles and/or plugs may be removed by any suitable method, for example, by mechanically removing the sacrificial nozzles and/or plugs using a coiled tubing or other devices or methods.

Next, the abrasive fluid and/or acid is displaced with another wellbore servicing fluid (for example, a proppant laden fracturing fluid that may or may not be similar to the abrasive wellbore servicing fluid) and the wellbore servicing fluid is pumped through the housing ports 228 to form and extend dominant fractures 256 in fluid communication with the perforation tunnels 254. The dominant fractures 256 may expand further and form micro-fractures in fluid communication with the dominant fractures 256. Generally, the dominant fractures 256 expand and/or propagate from the perforation tunnels 254 within the formation zone 12 to provide easier passage for production fluid (i.e., hydrocarbon) to the wellbore 114.

Figure 9:
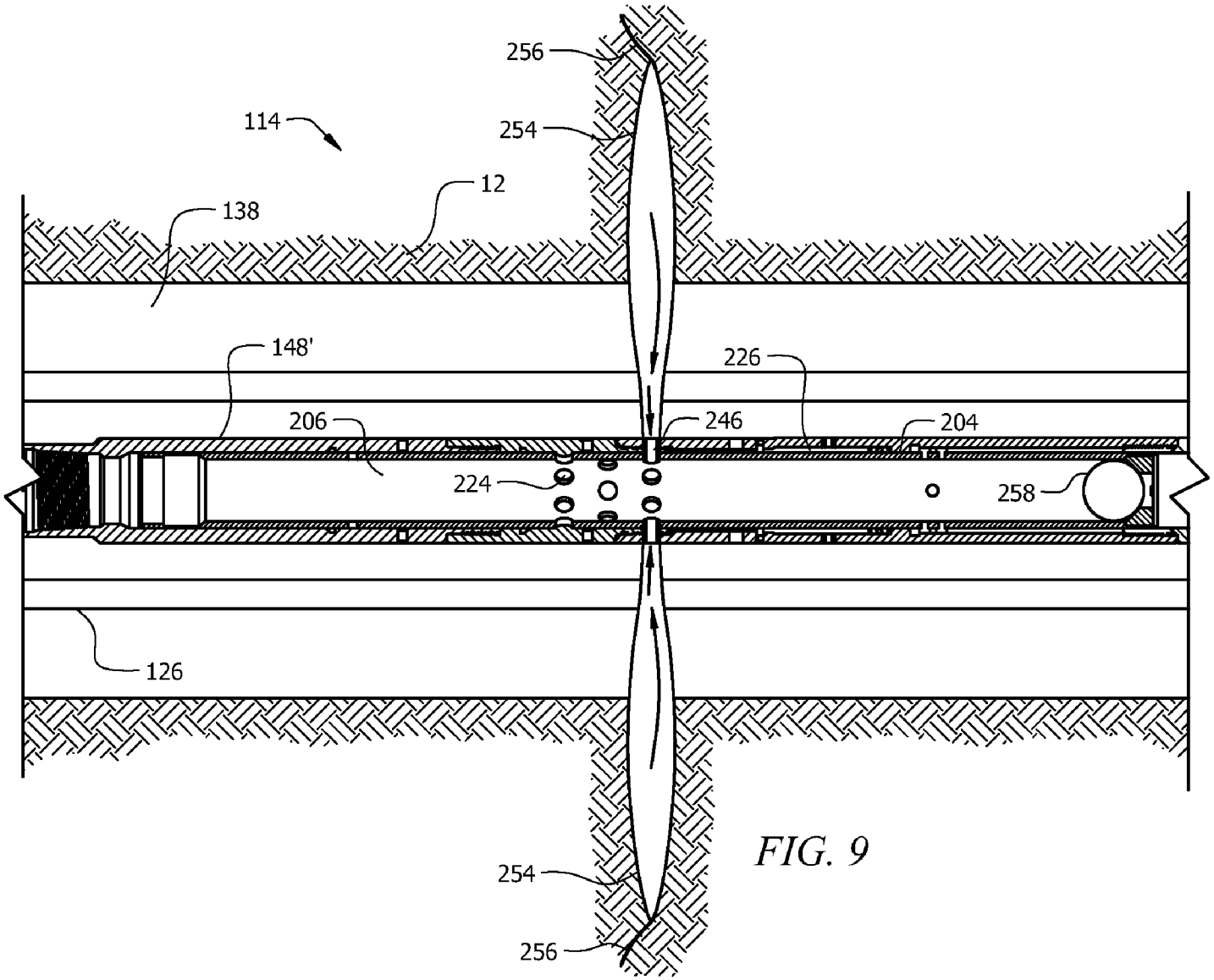
FIG. 9 is an orthogonal cross-sectional view of the stimulation assembly of FIG. 2 during the production of hydrocarbon.

Referring now to FIG. 9, the stimulation assembly 148' is illustrated as used during a hydrocarbon production step that is performed after creating the dominant/extended fractures 256. Production fluid, such as hydrocarbons from the formation zone 12, flows through the dominant/extended fractures 256, to the perforation tunnels 254, through the housing ports 228, through the annular gap 226, through the sleeve ports 224, and the into the flowbore 206.

The sacrificial nozzle 236' is one example of suitable sacrificial nozzle that is constructed of two materials (i.e., steel and aluminum) and thus has two removal methods (e.g., abrasion to remove the steel followed by abrasion and/or degradation (e.g., acidization) to remove aluminum). However, in alternative embodiments, the sacrificial nozzle may be constructed of one or more other suitable materials that may be removed by any suitable method. The type of materials, the hardness of materials, the composition of materials, the thickness of each material, the size of aperture, etc., of the sacrificial nozzle may be modified to suit the needs of a process. For example, the fluid interface may be constructed of one or more material compositions that have linear abrasive rate, or alternatively a non-linear abrasive rate. The housing interface may be constructed of a softer material that may be removed faster than a harder material used for the fluid interface. In an embodiment, the fluid interface, the housing interface, or both may be formed of layered materials having different removal rates (e.g., different hardness or degradation rates) such that the removal profile of the sacrificial nozzle may be customized.

Figure 10:
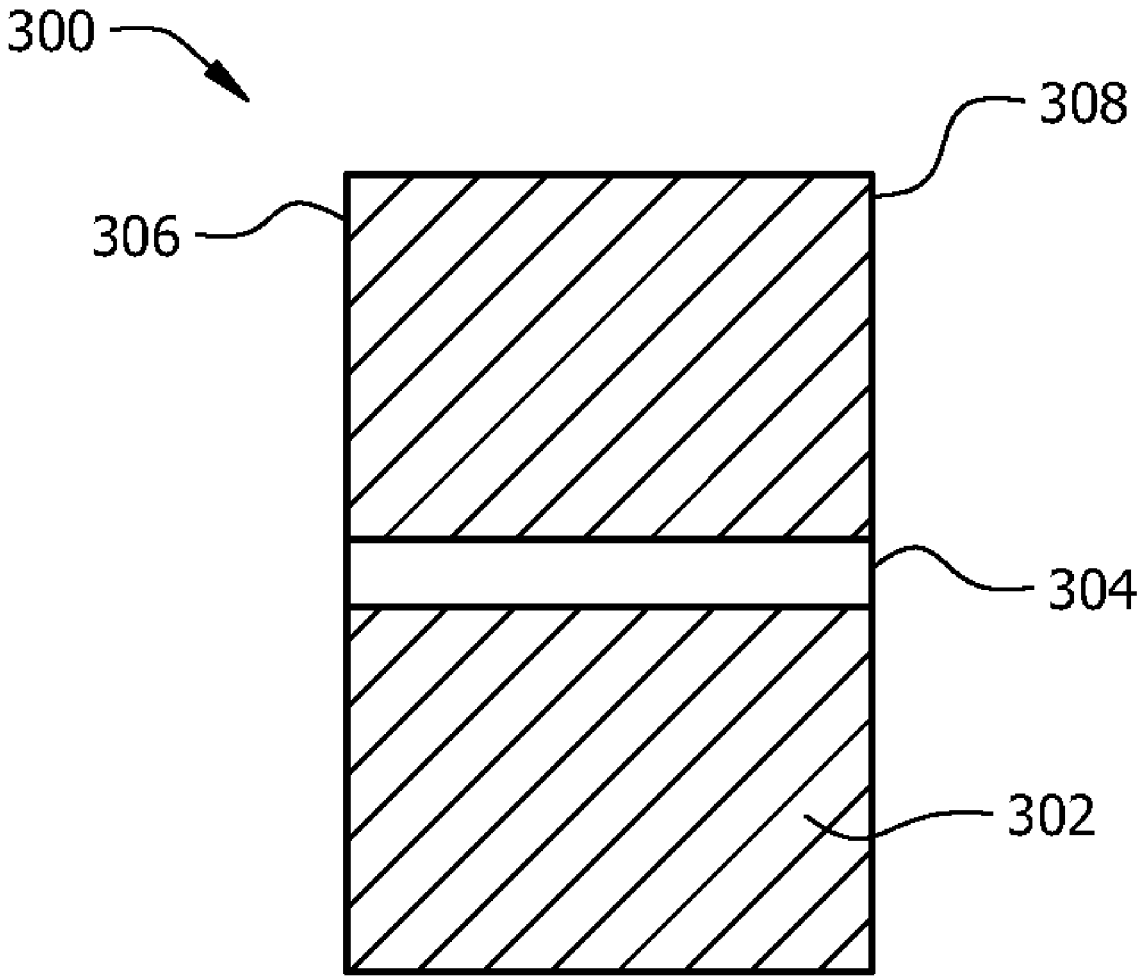
FIG. 10 is a cross-sectional view of another sacrificial nozzle.

Referring now to FIG. 10, an alternative sacrificial nozzle 300 is shown in greater detail. The alternative sacrificial nozzle 300 comprises an alternative sacrificial nozzle interface 302 that defines an alternative sacrificial nozzle aperture 304 as well as secures the alternative sacrificial nozzle interface 302 with respect to a housing of a stimulation assembly. The alternative sacrificial nozzle 300 also comprises an alternative sacrificial nozzle outer end 306 that faces a formation zone and an alternative sacrificial nozzle inner end 308 that faces a flowbore of the stimulation assembly. The alternative sacrificial nozzle 300 is constructed of steel that can be abraded with an abrasive wellbore servicing fluid and can be removed with a coiled tubing as described infra. In this way, the alternative sacrificial nozzle 300 can be sacrificed by abrasion and/or removal with a coiled tubing.

The operation of a stimulation assembly comprising at least one alternative sacrificial nozzle 300 is substantially similar to the operation of the stimulation assembly 148' described infra. The stimulation assembly comprising at least one alternative sacrificial nozzle 300 may be placed in a wellbore and positioned adjacent a formation zone to be treated. Initially, the stimulation assembly is in a closed position. Once the formation zone is ready for treatment, the stimulation assembly is opened (or partially opened). An abrasive wellbore servicing fluid may be pumped down and passed through the alternative sacrificial nozzle 300, abrades some portion of the alternative sacrificial nozzle 300, and increases the diameter of the alternative sacrificial nozzle aperture 304. The pressure of the abrasive wellbore servicing fluid is increased to from about 2000 to about 5000 psig, alternatively from about 2500 to about 4500 psig, alternatively from about 3000 to about 4000 psig and the pumping down of the abrasive wellbore servicing fluid is continued at a substantially constant pressure for a period of time. The abrasive wellbore servicing fluid is jetted from the alternative sacrificial nozzle 300 at sufficient velocity to erode the formation zone and form perforation tunnels (and optionally micro-fractures and/or extended fractures depending upon the treatment conditions and formation characteristics) within the formation zone. The remaining portion of the alternative sacrificial nozzle 300 may be removed via abrasion and/or removed mechanically by using a coiled tubing. However, in alternative embodiments, the alternative sacrificial nozzle may be removed by any suitable method. The abrasive wellbore servicing fluid (or other suitable wellbore servicing fluid such as a proppant laden fracturing fluid) is further pumped down to form dominant/extended fractures that may further comprise micro-fractures within the formation zone. Once the dominant fractures are formed and extended, hydrocarbons can be produced by flowing the hydrocarbons from the micro-fractures (if present), to the dominant fractures, to the perforation tunnels, and into the stimulation assembly.

Figure 11:
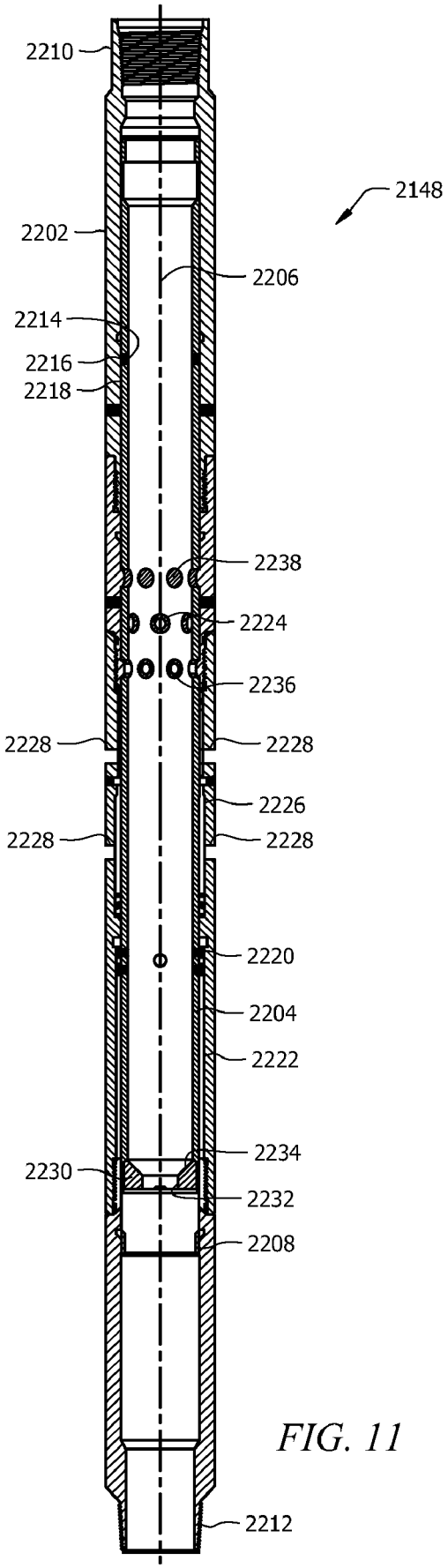
FIG. 11 is a cross-sectional view of another stimulation assembly.

Referring now to FIG. 11, an alternative embodiment of a stimulation assembly 2148 is shown in greater detail. The stimulation assembly 2148 is substantially similar to the stimulation assembly 148' in form and function except for the position of sacrificial nozzles 2236 and plugs 2238.

The stimulation assembly 2148 comprises a housing 2202 with a sleeve 2204 detachably connected therein. The housing 2202 comprises a plurality of housing ports 2228 defined therein. The sleeve 2204 comprises a sleeve lower end 2208 and a central flowbore 2206. After being detached from the housing 2202, the sleeve 2204 is slidable or movable in the housing 2202. The housing 2202 has a housing upper end 2210 and a housing lower end 2212. The sleeve 2204 is initially connected to the housing 2202 with a snap ring 2214 that extends into a groove 2216 defined on a housing inner surface 2218 of the housing 2202. In addition, shear pins extend through the housing 2202 and into the sleeve 2204 to detachably connect the sleeve 2204 to the housing 2202. Guide pins 2220 are threaded or otherwise attached to the sleeve 2204 and are received in axial grooves or axial slots 2222 of the housing 2202. The guide pins 2220 are slidable in the axial slots 2222 thereby preventing relative rotation between the sleeve 2204 and the housing 2202.

The sleeve 2204 comprises a plurality of sleeve ports 2224 therethrough. An annular gap 2226 formed by a recess of the interior wall of the housing 2202 serves to provide a fluid path between the sleeve ports 2224 and the housing ports 2228 when the sleeve ports 2224 are at least partially radially aligned with the annular gap 2226. The stimulation assembly 2148 further comprises at least one sacrificial nozzle 2236 and at least one plug 2238, each being positioned within separate and distinct sleeve ports 2224. In other words, each sleeve port 2224 comprises either the sacrificial nozzle 2236 or the plug 2238. In some alternative embodiments, a single stimulation assembly may have 18 to 24 sleeve ports. In those embodiments, there may be 10 to 16 sacrificial nozzles and 8 to 16 plugs positioned within the sleeve ports.

The sleeve 2204 further comprises a seat ring 2230 operably associated therewith and is connected therein at or near the sleeve lower end 2208. The seat ring 2230 has a seat ring central opening 2232 defining a seat ring diameter therethrough. The seat ring 2230 also has a seat surface 2234 for engaging an obturating member (e.g., a ball or dart) that may be dropped through the flowbore 2206.

The number of zones, the order in which the stimulation assemblies are used (e.g., partially and/or fully opened and/or closed), the stimulation assemblies, the wellbore servicing fluid, the sacrificial nozzles and plugs, etc. shown herein may be used in any suitable number and/or combination and the configurations shown herein are not intended to be limiting and are shown only for example purposes. Any desired number of formation zones may be treated or produced in any order.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A wellbore servicing apparatus, comprising:

a housing comprising a plurality of housing ports;

a sleeve being movable with respect to the housing, the sleeve comprising a plurality of sleeve ports to selectively provide a fluid flow path between the plurality of housing ports and the plurality of sleeve ports; and a sacrificial nozzle in fluid communication with at least one of the plurality of the housing ports and the plurality of sleeve ports.

2. The wellbore servicing apparatus according to claim 1, the sacrificial nozzle comprising:

a fluid interface defining an aperture; and a housing interface securing the fluid interface with respect to the housing.

3. The wellbore servicing apparatus according to claim 2, the sacrificial nozzle further comprising:

an inner end; and an outer end;

wherein at least one of the inner end the and outer end is beveled.

4. The wellbore servicing apparatus according to claim 2, wherein the fluid interface and the housing interface are constructed of different materials.

5. The wellbore servicing apparatus according to claim 2, wherein the fluid interface and the housing interface are constructed of the same material.

6. The wellbore servicing apparatus according to claim 2, wherein the fluid interface is constructed of a harder material than the material from which the housing interface is constructed.

7. The wellbore servicing apparatus according to claim 2, wherein the fluid interface is constructed of steel and the housing interface is constructed of aluminum.

8. The wellbore servicing apparatus according to claim 2, wherein the fluid interface is abradable by flowing an abrasive wellbore servicing fluid through the sacrificial nozzle.

9. The wellbore servicing apparatus according to claim 2, wherein the housing interface is degradable.

10. The wellbore servicing apparatus according to claim 9, wherein the housing interface is degradable by acid.

11. The wellbore servicing apparatus according to claim 2, wherein the housing interface is configured to be selectively mechanically removed.

12. The wellbore servicing apparatus according to claim 1, wherein the sacrificial nozzle is constructed of one of the group consisting of water soluble material, acid soluble material, thermally degradable material, and any combination thereof.

13. The wellbore servicing apparatus according to claim 1, further comprising:

a plug disposed within a housing port.

14. The wellbore servicing apparatus according to claim 13, wherein the plug is constructed of one of the group consisting of water soluble material, acid soluble material, thermally degradable material, and any combination thereof.

15. The wellbore servicing apparatus according to of claim 13, wherein the plug is removable by abrasion, degradation, or mechanical removal.

16. The wellbore servicing apparatus according to claim 13, wherein the plug is constructed of aluminum and is removable by exposing the plug to an acid.

17. A method of servicing a wellbore, comprising:

placing a stimulation assembly in the wellbore, the stimulation assembly comprising:

a housing comprising a plurality of housing ports;

a selectively adjustable sleeve comprising a plurality of sleeve ports; and a sacrificial nozzle in fluid communication with one of the plurality of the housing ports and the plurality of sleeve ports, the sacrificial nozzle comprising an aperture, a fluid interface, and a housing interface.

18. The method of servicing a wellbore according to claim 17, further comprising:

selectively adjusting the sleeve to provide a fluid path between at least one of the plurality of housing ports and at least one of the plurality of sleeve ports;

jetting a wellbore servicing fluid from the sacrificial nozzle; and forming at least one perforation tunnel in a subterranean formation.

19. The method of servicing a wellbore according to claim 18, further comprising:

eroding the fluid interface during the jetting.

20. The method of servicing a wellbore according to claim 19, further comprising:

removing the housing interface by degrading the housing interface with an acid.

21. The method of servicing a wellbore according to claim 20, further comprising:

after removing the housing interface by degrading the housing interface with an acid, pumping the wellbore servicing fluid into the stimulation assembly, through the plurality of housing ports and into the perforation tunnel; and extending a fracture that is in fluid communication with the perforation tunnel.

22. The method of servicing a wellbore according to claim 21, further comprising:

flowing a production fluid from the fracture, through the plurality of housing ports, and into the stimulation assembly.

23. The method of servicing a wellbore according to claim 17, the stimulation assembly further comprising:

a plug disposed within one of the plurality of the housing ports.

24. The method of servicing a wellbore according to claim 23, further comprising:

removing the plug by degrading the plug with an acid.

* * * * *